US010926942B2

(12) United States Patent
Har-Shai

(10) Patent No.: US 10,926,942 B2
(45) Date of Patent: Feb. 23, 2021

(54) AEROSOL VALVE CONFIGURATIONS

(71) Applicant: GreenSpense Ltd., Misgav (IL)

(72) Inventor: Gadi Har-Shai, Hod-HaSharon (IL)

(73) Assignee: GreenSpense Ltd., Misgav (IL)

( * ) Notice: Subject to any disclaimer, the term of this patent is extended or adjusted under 35 U.S.C. 154(b) by 0 days.

(21) Appl. No.: 16/074,150

(22) PCT Filed: Jan. 17, 2017

(86) PCT No.: PCT/IL2017/050061
§ 371 (c)(1),
(2) Date: Jul. 31, 2018

(87) PCT Pub. No.: WO2017/130186
PCT Pub. Date: Aug. 3, 2017

(65) Prior Publication Data

US 2019/0177076 A1 Jun. 13, 2019

Related U.S. Application Data

(60) Provisional application No. 62/289,248, filed on Jan. 31, 2016.

(51) Int. Cl.
*B65D 83/48* (2006.01)
*B65D 83/00* (2006.01)
*B65D 83/38* (2006.01)

(52) U.S. Cl.
CPC ..... *B65D 83/48* (2013.01); *B65D 83/0061* (2013.01); *B65D 83/38* (2013.01)

(58) Field of Classification Search
CPC ..... B65D 83/48; B65D 83/0061; B65D 83/38
USPC ..... 222/105
See application file for complete search history.

(56) References Cited

U.S. PATENT DOCUMENTS 3,672,543 A * 6/1972 Roper ..... B65D 83/0061 222/183
3,791,557 A * 2/1974 Venus, Jr. ..... B65D 83/0061 222/105
4,121,737 A * 10/1978 Kain ..... B65D 83/0061 222/212

(Continued)

FOREIGN PATENT DOCUMENTS

CN 1030554 1/1989
CN 2661618 12/2004

(Continued)

OTHER PUBLICATIONS

FR2707264 with machine translation (Year: 1995).*
DE2452495 with machine translation (Year: 1975).*
International Preliminary Report on Patentability dated Aug. 9, 2018 From the International Bureau of WIPO Re. Application No. PCT/IL2017/050061. (10 Pages).

(Continued)

*Primary Examiner* — Vishal Pancholi

(57) ABSTRACT

A propellant free continuous dispensing device comprises an inner bag surrounded by an elastic sleeve containing fluid under pressure, a valve attached to the inner bag to controllably release fluid, the valve mounted in a mounting cup, a package enclosing the inner bag and elastic sleeve which may be of non-metallic material, a flange closing the package at one end, the flange being sized for the mounting cup to fit within the flange, and wherein the flange and the mounting cup are provided with complementary shapes to allow for location of the mounting cap into the flange.

24 Claims, 13 Drawing Sheets

(56) References Cited

U.S. PATENT DOCUMENTS

| | | | | |
|---|---|---|---|---|
| 4,251,032 | A * | 2/1981 | Werding | B05B 1/3442 239/323 |
| 4,458,830 | A * | 7/1984 | Werding | B65D 83/0055 222/131 |
| 4,964,540 | A * | 10/1990 | Katz | B65D 83/0061 222/105 |
| 4,988,018 | A | 1/1991 | Loychuk | |
| 5,111,971 | A * | 5/1992 | Winer | B65D 83/0061 222/105 |
| 2008/0272145 | A1* | 11/2008 | Nimmo | B65D 83/62 222/95 |
| 2010/0133295 | A1* | 6/2010 | Chan | B29C 49/221 222/95 |
| 2011/0108574 | A1* | 5/2011 | Nimmo | B65B 31/003 222/95 |
| 2012/0097706 | A1* | 4/2012 | Nimmo | B65D 83/62 222/95 |

FOREIGN PATENT DOCUMENTS

| | | |
|---|---|---|
| CN | 1656010 | 8/2005 |
| CN | 105050917 | 11/2015 |
| DE | 2452495 | 7/1975 |
| EP | 0300886 | 1/1989 |
| FR | 2707264 | 1/1995 |
| WO | WO 03/099663 | 12/2003 |
| WO | WO 2007/051229 | 5/2007 |
| WO | WO 2007/093889 | 8/2007 |
| WO | WO 2017/130186 | 8/2017 |

OTHER PUBLICATIONS

International Search Report and the Written Opinion dated Jun. 21, 2017 From the International Searching Authority Re. Application No. PCT/IL2017/050061. (17 Pages).

Invitation to Pay Additional Fees and Communication Relating to the Results of the Partial International Search and the Provisional Opinion Accompanying the Partial Search Result dated Apr. 19, 2017 From the International Searching Authority Re. Application No. PCT/IL2017/050061. (10 Pages).

International Preliminary Report on Patentability dated Nov. 8, 2018 From the International Bureau of WIPO Re. Application No. PCT/IL2017/050469. (9 Pages).

Communication Pursuant to Article 94(3) EPC dated Jul. 29, 2019 From the European Patent Office Re. Application No. 17704833.7. (4 Pages).

Notification of Office Action and Search Report dated Nov. 4, 2019 From the State Intellectual Property Office of the People's Republic of China Re. Application No. 201780020874.5. ( 7 Pages).

Translation Dated Dec. 6, 2019 of Notification of Office Action dated Nov. 4, 2019 From the State Intellectual Property Office of the People's Republic of China Re. Application No. 201780020874.5. (4 Pages).

Notification of Office Action dated Jun. 23, 2020 From the State Intellectual Property Office of the People's Republic of China Re. Application No. 201780020874.5. (5 Pages).

Communication Pursuant to Article 94(3) EPC dated Apr. 17, 2020 From the European Patent Office Re. Application No. 17704833.7. (6 Pages).

* cited by examiner

Inner Bag (Eco-sleeve)
54
56
57
58
54
54
62
60
57
Swivel Actuator mounted ver an Aerosol valve
By rotating the actuator the valve's stem is pressed down and pressurized material is released
The valve is attached to the inner bag and external package and does not move during swivel of the actuator

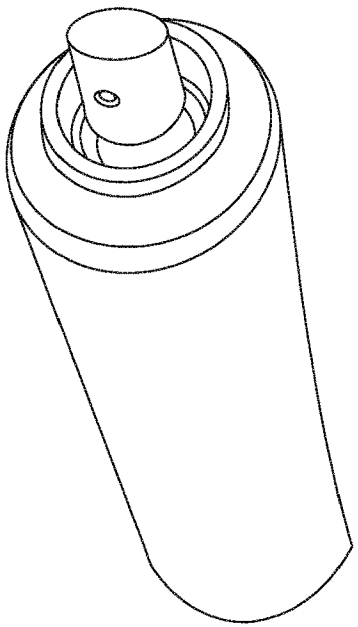
Fig. 16
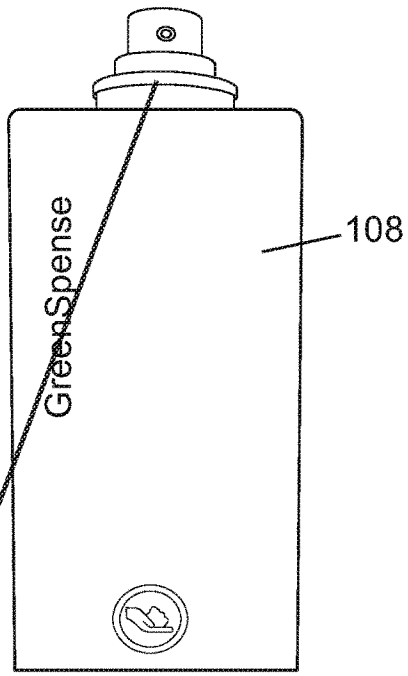
Fig. 15
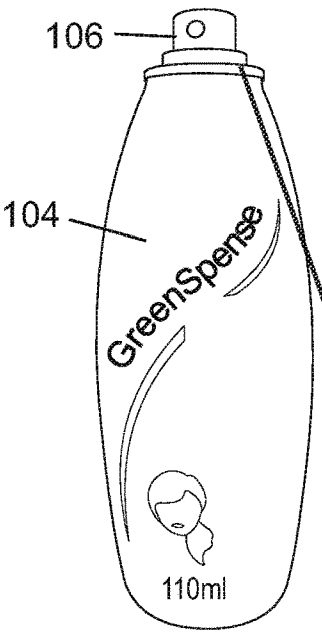
Fig. 14
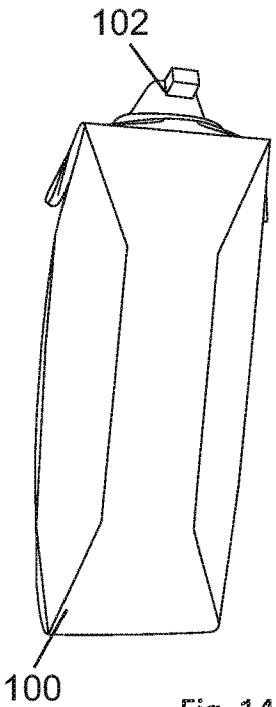

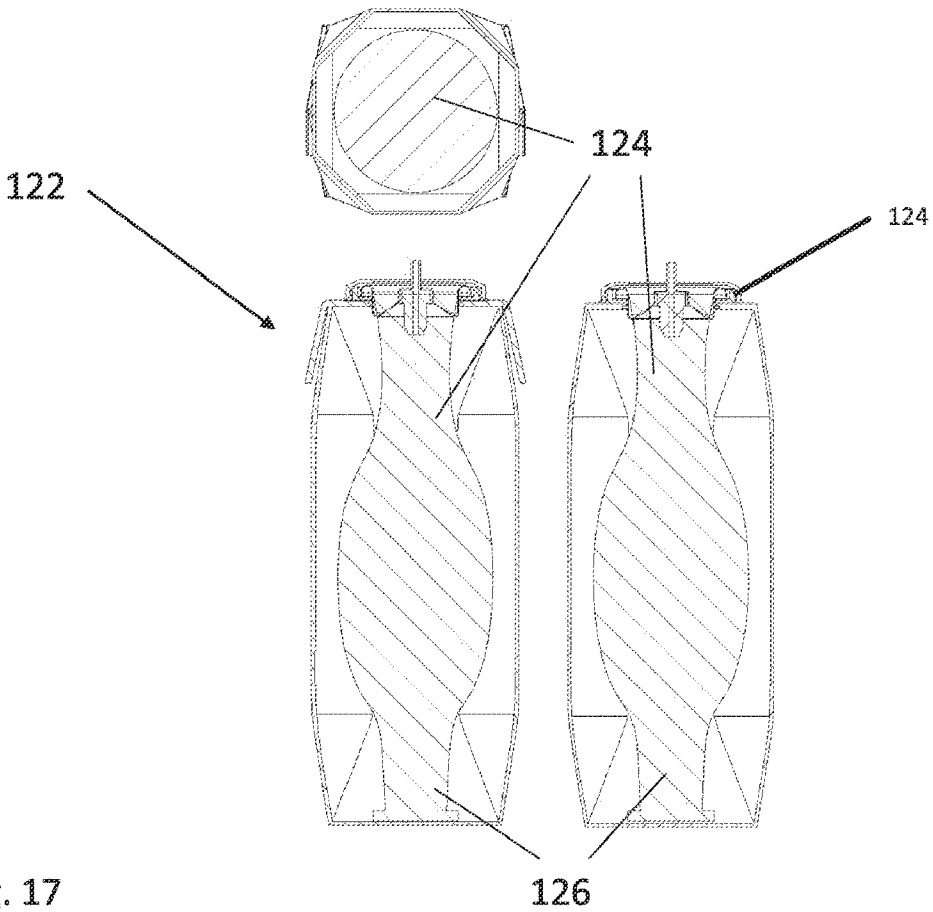
Fig. 17
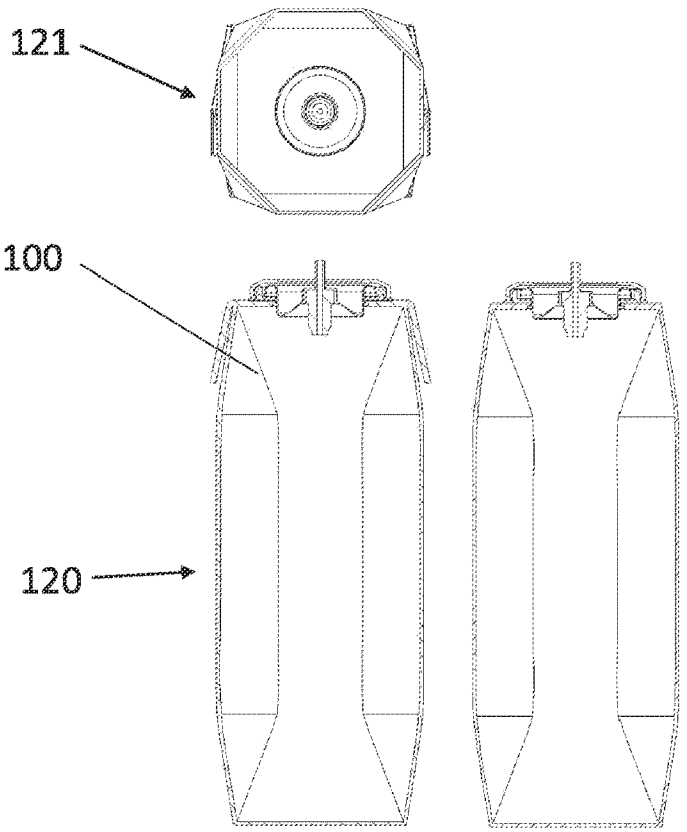

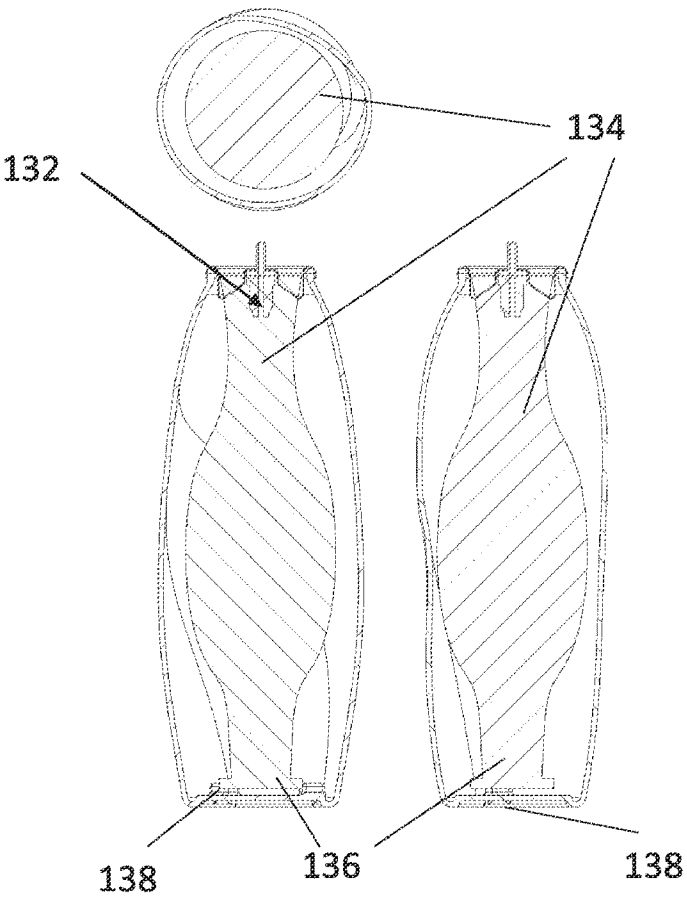
Fig. 18
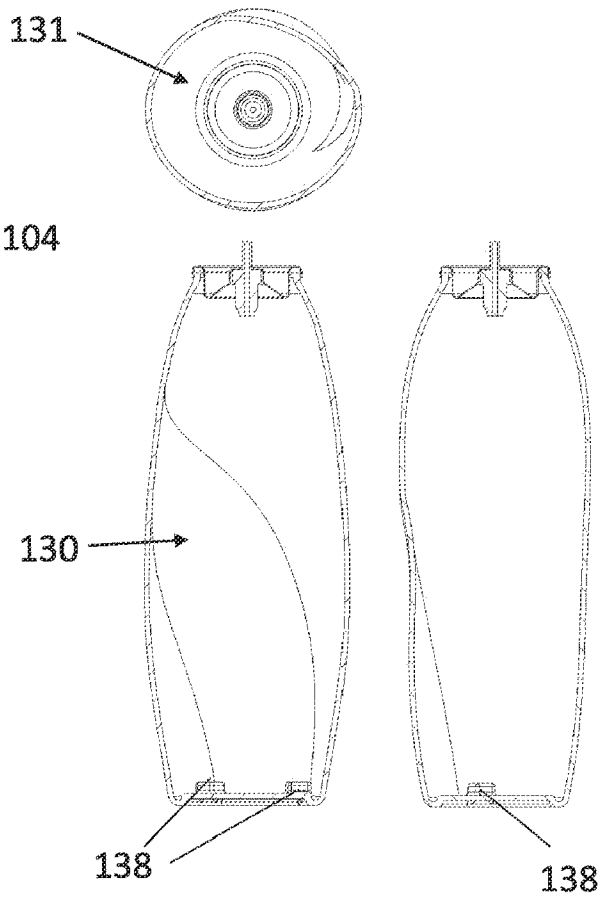

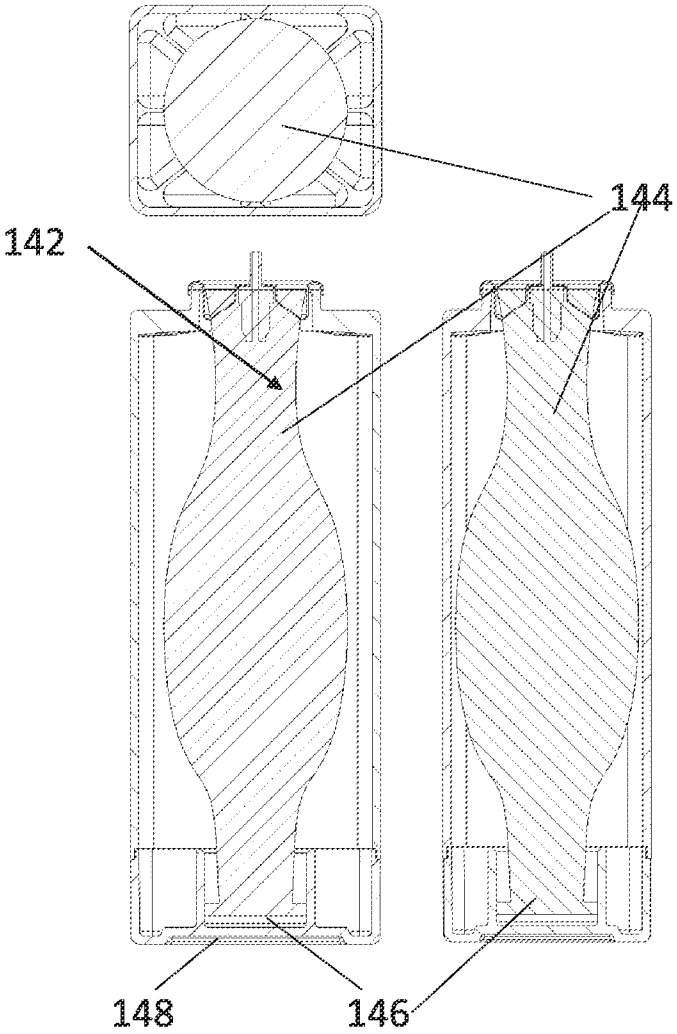
Fig. 19
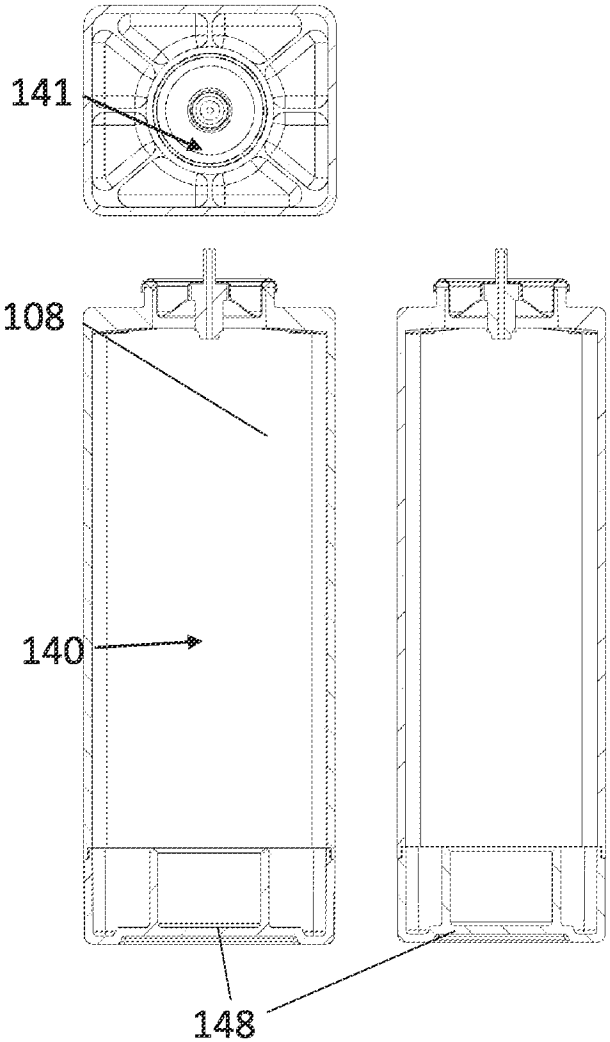

AEROSOL VALVE CONFIGURATIONS

RELATED APPLICATIONS

This application is a National Phase of PCT Patent Application No. PCT/IL2017/050061 having International filing date of Jan. 17, 2017, which claims the benefit of priority under 35 USC § 119(e) of U.S. Provisional Patent Application No. 62/289,248, filed on Jan. 31, 2016. The contents of the above applications are all incorporated by reference as if fully set forth herein in their entirety.

BACKGROUND OF THE INVENTION

The present invention relates to continuous dispensing devices and configurations therefor, and more particularly but not exclusively, to continuous dispensing devices that are propellant free.

The present disclosure is related to International Patent Application No. PCT/IL2016/051106 and to U.S. Pat. No. 9,409,698, both to the present assignees, the contents of which are both incorporated herein by reference in their entireties.

Aerosol spray canisters and like pressurized dispensing devices deliver materials under pressure. Single compartment canisters combine a propellant, i.e. pressurized gas (mainly LPG), mixed with the material being delivered and dispense both via the canister's valve. Dual compartment canisters separate the propellant from the material being delivered, where the propellant surrounds an inner bag containing the material and connected to the valve. The propellant applies pressure on the inner bag which transfers this pressure to the material thereby enabling it to extract through the released valve.

There are two standard valve configurations—a stand-alone aerosol valve used for single compartment dispensing, and a Bag On Valve (BOV) configuration where an inner bag of the dispensing device is attached to the aerosol valve; this configuration being in use for dual compartment dispensing. The outer wall of the canister is typically metal to withstand the pressure of the propellant.

A propellant-free technology, for example that of the same Applicants and substantially as described in U.S. Pat. No. 9,409,698 and PCT application WO2014111939, provides for an elastic sleeve to surround a single compartment. As the elastic sleeve provides the pressure and there is no propellant, the design does not necessitate that the outer wall of the canister be able to withstand pressure.

Nevertheless the mechanical integrity of the canister needs to be preserved. Thus the canister must be resistant in particular to vertical mechanical pressure of filling process, dropping or stacking and may be required to allow a user to press from above to use the canister while say the canister is supported from below, without causing the canister to collapse. Furthermore, crimping, used to attach the valve holder to the canister body requires metal and is difficult to apply on non-metal canisters, as these are liable to break under attempts at crimping processes. Likewise, clinching cannot be implemented on soft material packaging, as the package is liable to tear under the latter process.

A known process was developed by Power Container (USA), comprising a plastic cover that secures a valve to a plastic container by snapping. However the valve used is not a standard aerosol valve, and thus the solution provided is not generically applicable. Reference is made in this regard to Power Container Patent Applications EP 2188191 and US20120097706.

SUMMARY OF THE INVENTION

Embodiments of the present invention provide dispensing device valve configurations and modifications for a propellant-free aerosol canister. As there is no propellant, the outer packaging need not be metal. The present embodiments discuss packaging types and materials, fixing of the valve to the packaging material, fixing of the internal dispenser sub-assembly within the packaging and mechanical strengthening to allow the resulting package to withstand vertical pressure.

Embodiments include an attachment of the mounting cup, whether metallic or plastic, to a non-metal canister, and may provide a continuous column from the valve to the base of the canister.

According to an aspect of the present embodiments there is provided a propellant free continuous dispensing device comprising:

an inner bag containing fluid or viscous materials under pressure;

a valve attached to the inner bag to controllably release the fluid, the valve mounted in a mounting cup;

a package enclosing the inner bag, the package having a first end and a base end opposite the first end;

a flange closing the package at the first end, the flange being sized for the mounting cup to fit within the flange.

In an embodiment, the flange and the mounting cup are provided with complementary shapes respectively, the complementary shapes allowing location of the mounting cap into the flange.

In an embodiment, the flange comprises two flange ends and a rim of the mounting cup is closed within the ends.

In an embodiment, the mounting cup comprises a rim and a peripheral indentation underneath the rim for crimping of the flange.

An embodiment may comprise a rigid column extending from the valve along a length of the pressurized container and extending towards the base end of the package, thereby to provide mechanical rigidity over a vertical dimension of the device.

In an embodiment, the base end of the package comprises at least one locator for locating the rigid column.

In an embodiment, the rigid column comprises a column extension for reaching or connecting the base end of the package.

In an embodiment, the flange is non-metallic.

In an embodiment, the package is non-metallic.

In an embodiment, the package is injection moulded.

In an embodiment, the package is blow moulded.

In an embodiment, the package comprises plastic or glass.

In an embodiment, the package is folded from a sheet.

In an embodiment, the sheet comprises a biodegradable material.

In an embodiment, the sheet comprises cardboard.

In an embodiment, the cardboard is laminated with a layer, the layer being one member of the group comprising plastics, polyethylene polypropylene, and polyamide.

In an embodiment, the inner bag is pressurized by an elastic sleeve.

In an embodiment, the valve is operated by pressing into the package against a restoring force.

In an embodiment the valve is a tilting valve operated by tilting to one side against a restoring force.

In an embodiment, the valve is operated by rotation against a restoring force.

In an embodiment, the rotation is carried out for continuous or dosed dispensing.

In an embodiment, the complementary shapes comprise at least one groove and at least one corresponding protrusion.

In an embodiment, the at least one groove and the at least one corresponding protrusion are continuous around different ones of an outer circumferential contour of the cup and an inner circumferential contour of the flange.

In an embodiment, the complimentary shapes comprising at least one lug and at least one locating hole.

In an embodiment, the complementary shapes comprise corresponding spiral threads.

In an embodiment, at least one of the flange and the cup is springy to allow snap-together fitting of the cup into the flange.

According to a second aspect there is provided a propellant free continuous dispensing device comprising:

an inner bag containing fluid or viscous materials under pressure;

a valve attached to the inner bag to controllably release the fluid, the valve mounted in a mounting cup;

a package enclosing the inner bag, the package having a first end and a base end opposite the first end; and a rigid column extending from the first end, through the pressurized container to the base end.

In an embodiment, the rigid column comprises a first part extending from the valve along a length of the inner bag and a second part affixed to the first part extending from the first part to the base end.

According to a third aspect of the present embodiments there is provided a propellant free continuous dispensing device comprising:

an inner bag containing fluid or viscous materials under pressure;

a valve attached to the inner bag to controllably release the fluid, the valve mounted in a mounting cup, the valve being mounted to rotate against a restoring force to open and carry out the controlled release.

According to a fourth aspect of the present embodiments there is provided a propellant free continuous dispensing device comprising:

An inner bag containing fluid under pressure;

a valve attached to the inner bag to controllably release the fluid, the valve mounted in a mounting cup, the valve mounted to be opened by tilting a lever sideways against a restoring force.

According to a fifth aspect of the present embodiments there is provided a propellant free continuous dispensing device comprising:

An inner bag containing fluid under pressure;

a valve attached to the pressurized container to controllably release the fluid, the valve mounted in a mounting cup, the valve being held within packaging, and wherein the packaging comprises a box obtained by folding a sheet.

According to a sixth aspect of the present embodiments there is provided a method of manufacturing a propellant free continuous dispensing device comprising:

providing an inner bag;

surrounding the inner bag with an elastic sleeve;

attaching a control release valve mounted in a mounting cup to the inner bag;

enclosing the inner bag in a package, the package having a first end and a base end opposite the first end, and the first end including a flange structure; and fitting the mounting cap within the flange by locating together complementary shapes on the mounting cap and the flange.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings and photographs. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings:

FIG. 14 illustrates a canister where the outer packaging is made of cardboard folded from a sheet according to an embodiment of the present invention;

FIG. 15 illustrates a canister made of blow molded plastic according to an embodiment of the present invention;

FIG. 16 illustrates a canister made of injection molded plastic according to an embodiment of the present invention;

FIG. 17 shows cross sections of the cardboard packaging alone and containing the pressure container with column construction according to an embodiment of the present invention;

FIG. 18 shows cross sections of the blow molded packaging alone and containing the pressure container with column construction according to an embodiment of the present invention;

FIG. 19 shows cross sections of the injection molded packaging alone and containing the pressure container with column construction according to an embodiment of the present invention;

DETAILED DESCRIPTION OF THE PRESENT EMBODIMENTS

The present invention, in some embodiments thereof, relates to continuous dispensing valve configurations and dispensing canisters, and more particularly but not exclusively to valve fixing configurations and canisters for propellant free aerosols.

The present embodiments may provide an attachment configuration for an continuous dispensing valve that offers an alternative locking process to the crimping or clinching that is used today and is based on surrounding canister parts which are made of metal. Snapping, gluing and screwing are additional ways of attaching parts but are not used today with aerosol valves because they are not fluid tight. While crimping and clinching were designed to seal the valve to the canister, with propellant-free technology there is no propellant that needs to be confined and thus these connection methods are redundant. Only locking (not sealing) for safety purposes is required as described herein. However, mechanical integrity and the ability to stack may still be required.

The present embodiments may provide a locking mechanism for aerosol valves, to attach the standard valve mounting cup to a container material which need not be metallic. Furthermore, a column is provided through the inner bag, pressurized by surrounding elastic sleeve, and the column may be extended to the floor of the container, to give strength to the container in the vertical direction to make up for lack of mechanical strength in the walls of the container. The present embodiments thus provide a modified aerosol valve and construction which may be used with non-metallic containers. Herein the term 'packaging' is used to refer to the outer surrounding of the pressurized inner bag sub-assembly, and the sub-assembly inside the packaging is referred to as a continuous dispensing device, even though the packaging is not necessarily metallic.

A propellant free continuous dispensing device comprises an inner bag containing fluid under pressure, a valve attached to the pressurized inner bag and elastic sleeve, to controllably release fluid, a package enclosing the pressurized inner bag and elastic sleeve which may be made of a polymeric component, and in one embodiment, a flange closes the package at one end, the flange being sized for the mounting cup that holds the valve to fit within the flange, and wherein the flange and the mounting cup are provided with complementary shapes to allow for location of the mounting cap into the flange. Complementary shapes may include lugs and holes that correspond on opposite surfaces, or corresponding threads allowing for the cup to be screwed into the flange, or projections and grooves designed for a snap fit, or simply corresponding mating surfaces that allow for glue.

Figure 1B:
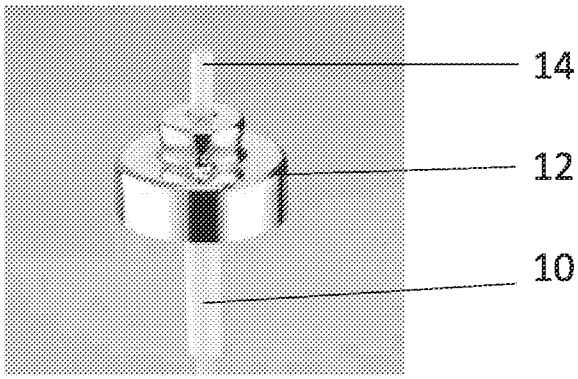
Fig. 1B Prior Art
FIGS. 1A and 1B provide two examples of standard aerosol valves.
Figure 1A:
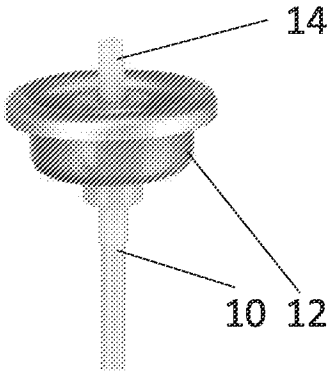
Fig. 1A Prior Art
Figure 2:
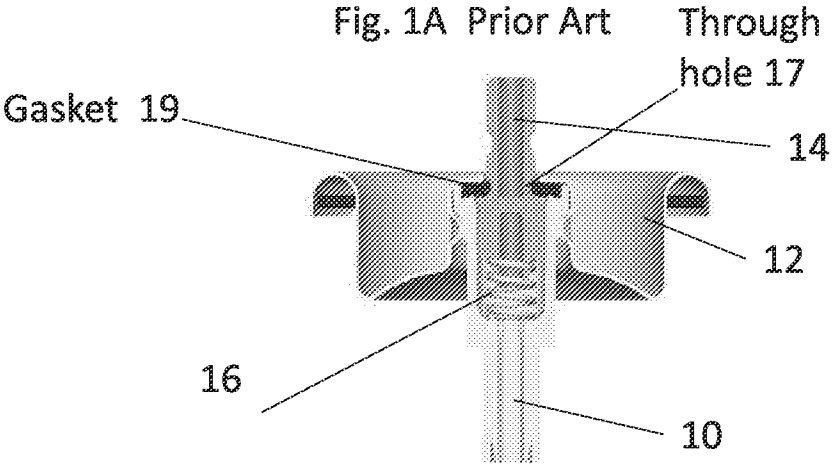
Fig. 2 Prior Art
FIG. 2 is a cross-section of a standard aerosol valve.

In the known art, a standard continuous dispensing valve is mounted to metal dispensing canisters by mechanical attachment of the valve's metal housing (i.e. the mounting cup) to the canister. FIGS. 1A and 1B show two standard aerosol valves, a standard 1" valve in FIG. 1A and a standard 20 mm valve in FIG. 1B. FIG. 2 is a cross-section of a standard aerosol valve, such as the 1" valve, indicating the dip tube 10 and mounting cup 12 of the valve. Stem 14 is pushed up by a resilient component such as a coiled spring 16 to seal through hole 17 of the stem 14 using gasket 19. As the stem is pressed against the restoring force of the resilient component, the through hole of the stem moves out of the gasket 19 and fluid is forced out by the pressure of the propellant.

Figure 3:
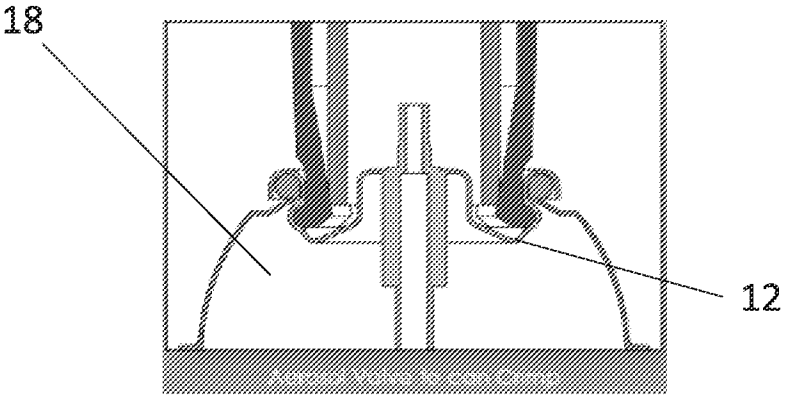
Fig. 3 Prior Art
FIG. 3 is a simplified schematic cross-section of a standard crimping process.

Two processes used today for securing and sealing the valve to the canister in order to avoid leakage of gas and prevent other safety risks are known as crimping and clinching. An exemplary crimping process is provided in FIG. 3, where it may be seen that the mounting cup 12 is bent under the rim of metal canister 18, to seal and secure the valve to the canister.

A propellant-free technology, for example that of the same Applicants and substantially as described in PCT applications WO2012117401 and WO2014111939, does not necessitate that canisters are made of metal, since an elastic sleeve is used to provide pressure to the inner bag, and therefore canisters made of many other materials, e.g., cardboard or plastic may be used, as will be discussed hereinbelow.

However, since crimping is difficult to apply on non-metal canisters, as these are liable to break under this process, and clinching cannot be implemented on soft material packaging, as the package is liable to tear under the latter process, there is a need to develop an alternative attachment of the mounting cup, irrespective of whether the cup itself is metal or plastic, to a non-metal canister.

The present invention in one embodiment consists of a standard aerosol valve which is modified for a new attachment mechanism by providing complementary shapes on the container top and the mounting cup so that they can be snapped, screwed or otherwise brought into a fixed position. One embodiment involves adding a peripheral protrusion to the lower part of the mounting cup and a corresponding inclusion or groove on the canister wall. The protrusion may be continuous or intermittent, or may comprise one or more locating lugs and corresponding reception holes. The male part of the complementary shape may be on the mounting cup and the female part on the canister wall or vice versa.

Before explaining various embodiments of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 5:
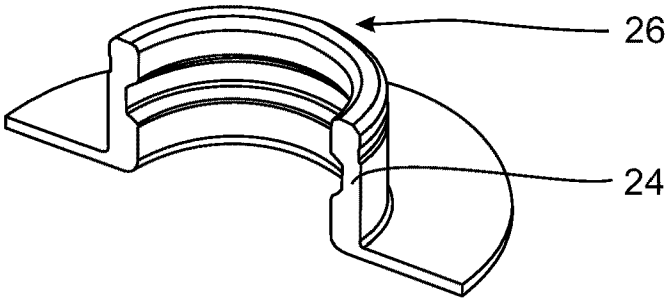
FIG. 5 is a simplified schematic view of a flange with a peripheral indentation, according to an embodiment of the present invention.
Figure 4:
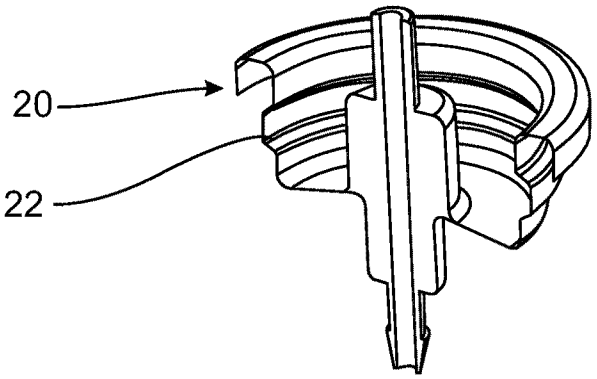
FIG. 4 is a simplified schematic view of a valve mounting cup with protrusion, according to an embodiment of the present invention.
Figure 6:
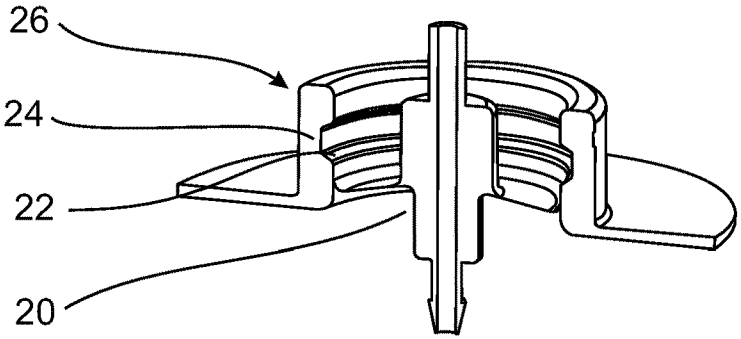
FIG. 6 is a simplified schematic view of a mounting cup snapped into a flange, according to an embodiment of the present invention.

Reference is now made to FIG. 4, which is a simplified diagram showing a valve mounting cup 20 with a protrusion 22 built into the wall of the cup 20 according to an embodiment of the present invention. The protrusion is sized to fit a peripheral indentation or groove 24 that is designed in a flange 26, as for example shown in FIG. 5. The flange may be plastic, or metal, including soft metals such as tin and aluminum. The indentation 24, and the corresponding protrusion 22, may be continuous or intermittent and the indentation and protrusion form complementary shapes which serve to fix the cup in the package. FIG. 6 shows the cup 20 inserted into the flange 26, and shows how the protrusion 22 fits into the indentation 24 to fix the cup 20 in place.

As mentioned, in an alternative embodiment, the mounting cup may have an indentation and the flange may have a protrusion.

The flange may be made of plastic. The flange may alternatively be made of a soft metal such as tin-plate, aluminum, or such like. The flange is for example of a type such as currently used to secure the cap in cardboard packaging, where a cap is connected to the cardboard, or a flange attached to plastic packages by heat welding or other means. In a collapsible tube, plastic bottle, laminated pouch, etc., a cap/closure that is screwed, snapped or heat welded or glued to the package may be used. The flange may be an integral part of the package or may be an addition to the package.

By snapping the mounting cup into the plastic flange, the protrusion 22 on the valve cup 20 enters the indentation 24 in the flange 26 and is locked therein, say via a snap fit. Locking may be irreversible, or substantially irreversible so that the valve cannot be separated from the package by the end user, for purposes of safety or integrity.

The mounting cup and flange may be attached alternatively by snapping and screwing or snapping and gluing the mounting cup into the plastic flange.

The aerosol valve may be for example a standard 1", a 20 mm or any other aerosol valve. The mounting cup may for example be made of tin-plate, aluminum, plastic or other materials.

The plastic flange may be made of HDPE, LDPE, PP or other standard materials as currently in use in packaging. The flange dimensions are designed in order to suit the aerosol valve and the container package.

The container package may be made of cardboard—non-coated cardboard or coated cardboard (such as used by Tetra Pak (Sweden), Evergreen Packaging (USA), and so on) having a box shape, rectangular, round, etc. Plastic containers may be made of HDPE, LDPE, PET, PE, PA, PP etc., having the shape of bottles, containers, collapsible tubes, flexible packaging, and so on, and examples are given hereinbelow. More generally, the package may be non-coated or coated cardboard, rigid or flexible plastic, metal, glass, wood, or a hybrid of several materials.

Figure 7:
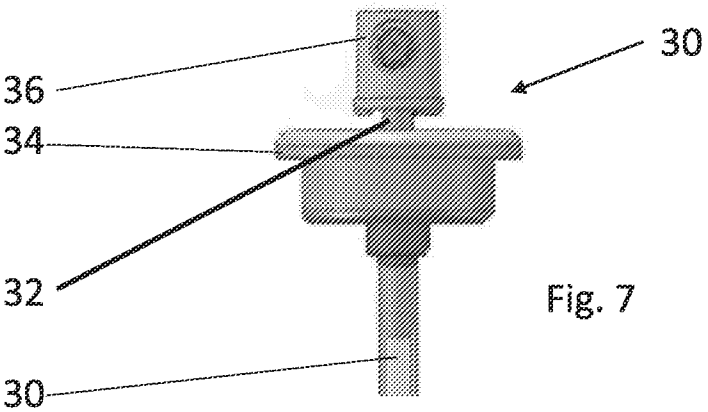
FIG. 7 is a simplified schematic view of standard press-down actuation of the valve as used in embodiments of the present invention.

As explained above, with propellant free technology, the external packaging for the aerosol no longer has to be metal and may be made of plastic or other materials instead. Indeed, flexible packaging to form laminated pouches, collapsible tubes or rigid tubes may be possible. The greater flexibility in packaging may thus enable different shapes of packaging and more applications in which aerosol spray can be used, such as toothpaste, sealing products, creams, foodstuffs such as ketchup, mayonnaise, mustard, etc. for example, and for these products, the current finger press actuation as shown in FIG. 7, may not be the only solution for the valve. Alternative possibilities include a tilt valve as shown in FIG. 8 and a swivel actuator as shown in FIGS. 9 and 10.

Referring now to FIG. 7, which shows a valve 30 having a dip tube 32 and mounting cup 34. A standard fingerpress aerosol actuator 36 is mounted over the valve's stem 32 above the cup and by pressing down the actuator, e.g., using the index finger, the stem is pressed down and opens a gap in the valve to release the pressurized material which is contained in the canister, thus allowing one-handed operation using the same hand that holds the canister. A restoring force, such as that provided by a spring, returns the valve to a closed position when the finger is removed.

Figure 8:
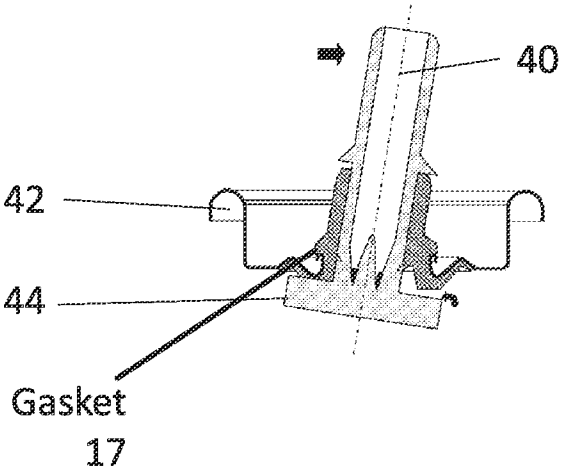
FIG. 8 is a simplified schematic view of a tilt actuation of the valve, according to an embodiment of the present invention.

Reference is now made to FIG. 8, which is a simplified diagram showing another type of actuator, in which a tilt movement of a lever 40 opens the valve. The lever is mounted within cup 42 and a gasket tilts stem 44 to open a gap between the gasket and the lever. The valve releases the pressurized material as a result of the tilting which affects both the valve stem and the actuator, and tilting may again be achieved using the index finger of the hand holding the canister. A restoring force, provided for example by the gasket, returns the lever to a closed position when the finger is removed.

Figure 9:
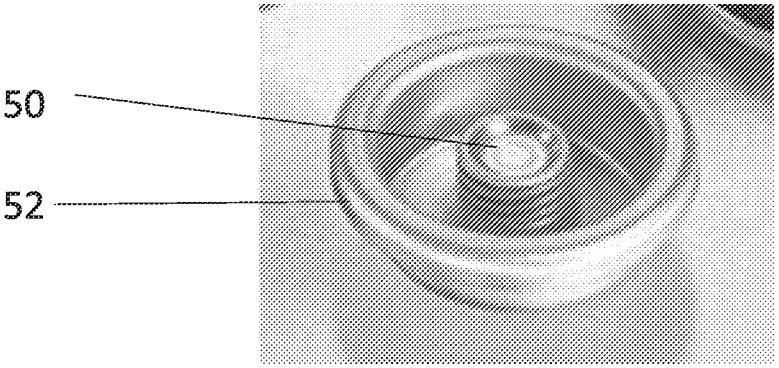
FIG. 9 is a simplified schematic view of an aerosol mounting cup with threaded stem housing, according to an embodiment of the present invention.
Figure 10:
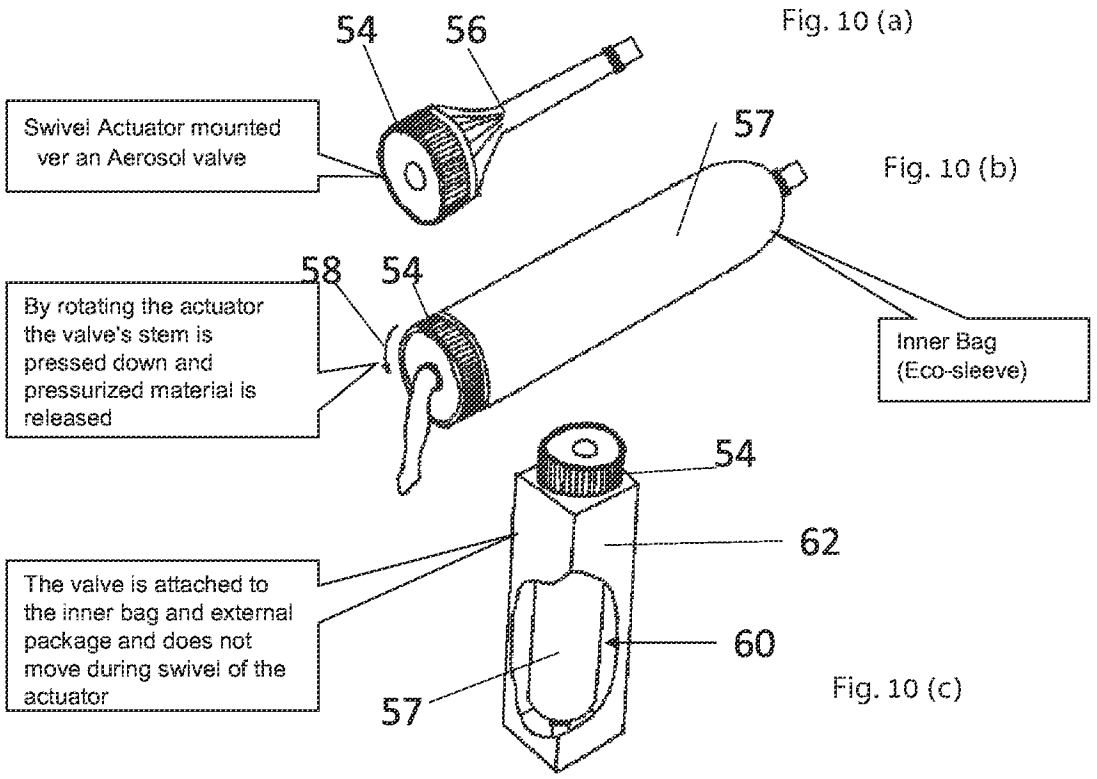
FIGS. 10(*a*)-10(*c*) are a simplified schematic view of a swivel actuator mechanism, according to an embodiment of the present invention.

Reference is now made to FIG. 9, which shows a threaded connector 50 within cup 52. The present embodiments provide swivel movement actuation which results in the valve's stem being pressed down to allow release of the pressurized material in the container.

The center of the swivel motion actuator may comprise a screw thread that is fitted to the valve's stem housing thread.

By rotating the actuator, e.g., using the thumb and index finger while other fingers surround and hold the package, the actuator rotates downwards on the thread and presses the stem downwards, releasing material in the same way as in FIG. 7. The rotation operation is carried out against a restoring force, typically provided by a resisting spring, so that the actuator returns to its initial position after use, when fingers are removed from the actuator.

The present embodiments thus provide a swivel motion actuator for release of material from a dispensing container or canister.

The swivel valve may comprise a threaded nut located at the center of the actuator fitted to a stem housing thread of a valve.

Reference is now made to FIGS. 10(*a*)-10(*c*), which provide a simplified representation of the swivel or rotary actuator mechanism, according to an embodiment of the invention. FIG. 10(*a*) shows a swivel actuator 54 mounted over an aerosol valve 56. FIG. 10(*b*) shows the actuator 54 and the inner bag 57 filled with material under pressure and indicates how by rotating the swivel actuator 54 in accordance with arrow 58, the valve stem is pressed down and thereby pressurized material contained in the canister or container is released. FIG. 10(*c*) shows an open section 60 of the container packaging. As indicated, the valve 54 is attached to the inner bag 57 of the container and to the external package 62 and does not move, e.g., rotate, during the swivel motion of the actuator 54.

The actuator 54 may be made of polyethylene PE or polypropylene PP or any other standard materials currently utilized for actuators.

The actuator dispensing structure (i.e., nozzle, liquid path, etc.) and size may be similar to that commonly used with standard aerosol actuation.

The actuator may have continuous and varying dosage capabilities.

Figure 11:
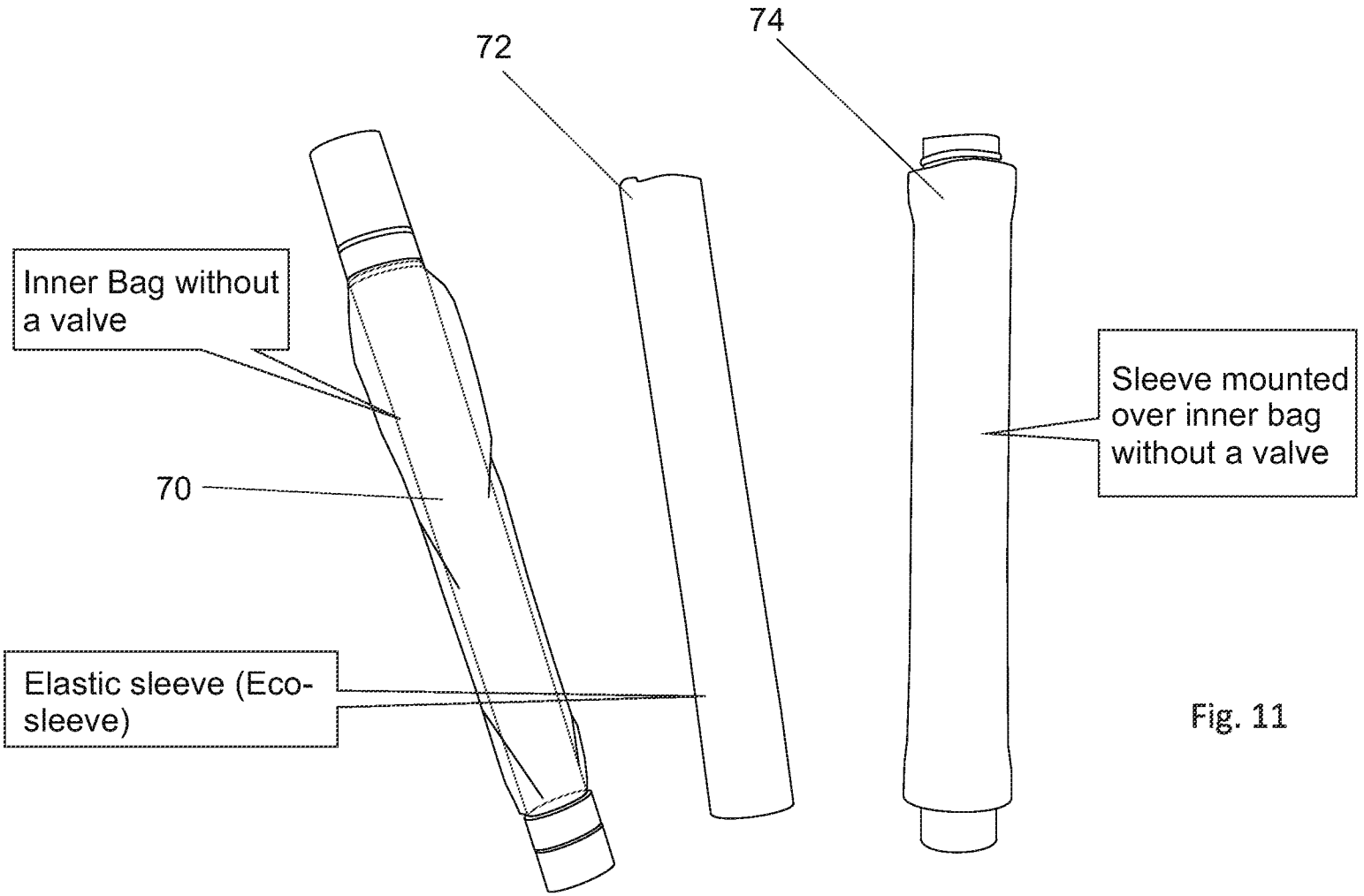
FIG. 11 shows three views of a sleeve on bag construction around a central column according to an embodiment of the present invention.

Reference is now made to FIG. 11 which illustrates a pressure sleeve on an inner bag without a valve. Providing the parts without a valve leaves the option of attaching different valve types and from different manufacturers to a single type of sleeve and bag.

It is therefore possible to provide an elastic sleeve on the inner bag as a sub-assembly formed without being attached to a valve.

There are currently two standard valve configurations in use: a stand-alone aerosol valve used for single compartment dispensing and a Bag On Valve (BOV) where an inner bag of the device is attached to the aerosol valve. The latter is employed for dual compartment dispensing.

The present embodiments comprise an elastic sleeve that is mounted over an inner bag without a valve attached, so that the resulting sub-assembly may subsequently be fitted to any valve. FIG. 11 shows an inner bag 70 without a valve, mounted over an inner column, an elastic sleeve 72, e.g. an eco-sleeve, and a sub-assembly 74 in which the sleeve 72 is mounted over the inner bag 70. No valve is provided so that the entity filling the aerosol with spray substance may select their own choice of valve.

The inner bag 70 may be constructed from flexible materials made for example by processes such as lamination, co-extrusion, blow molding etc. The elastic sleeve 72 is made of an elastic material or elastomer such as rubber, silicone etc.

After the elastic sleeve is mounted over the inner bag it is ready for vacuum and valve assembly. The valve may be a 1" valve, a 20 mm valve or any other valve.

Attachment of the valve to the sleeve on bag device may be done by heat welding or any other mechanical connection, e.g., snapping, screwing, locking, or chemical connection such as gluing.

Figure 12:
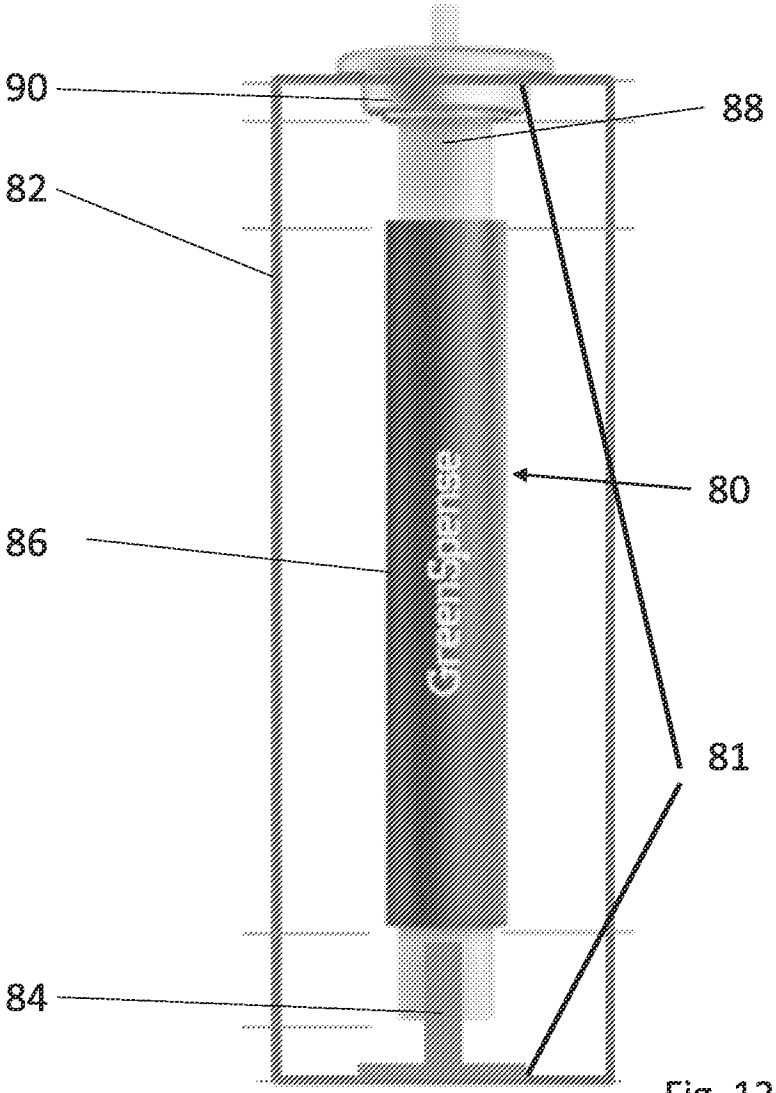
FIG. 12 shows a column construction with a foot or extension element to reach the base of the canister packaging according to an embodiment of the present invention.

Reference is now made to FIG. 12, which is a cross-sectional illustration of a propellant free aerosol sub-assembly 80 according to the present embodiments within a package 82 and including a supporting foot 84 for mechanical integrity. The sub-assembly comprises a central column, an inner bag, a surrounding pressure sleeve 86, and an aerosol valve 88 with cup 90. The supporting foot 84 is a strut which extends from the central column to the base of package 82 and thus gives the package mechanical rigidity in the vertical direction, that is along the height dimension indicated by reference numeral 81. Mechanical rigidity allows containers to be stacked, improve resistance of the package when dropped, and also allows the valve to be pressed from above during the filling process while supported from below.

FIG. 12 illustrates a propellant free continuous dispensing device having an inner bag surrounded by an elastic sleeve here shown empty but in use containing fluid under pressure. A valve is attached to the inner bag to controllably release content from within. The valve may be mounted in a mounting cup 90. Package 82 encloses a non-pressurized container. The flange as shown in FIG. 5 closes the package at the valve end, and fits the mounting cup so that the mounting cup is fixed within the flange. The flange and mounting cup are provided with complementary shapes as discussed, such as a corresponding protrusion around the wall of the cup and an indentation or groove for the protrusion to fit in, or lugs and corresponding holes or any shape that fixes the cup to the packaging. In one embodiment the valve may screw in to the package and the corresponding shapes may be spiral threads. In the case of the rotary actuator, the complementary shape may be designed to prevent rotation of the valve with respect to the package, but with other embodiments this is not essential.

The flange or the cup or both may be springy to allow snap-together fitting of the cup into the flange.

As shown in FIG. 12, a rigid column extends from the valve along a length of the container towards the base of the package 82 and can be fixed there mechanically, by heat welding, glue, snap etc. Another option is that a portion of the column is provided already attached to the package at the bottom and connects to the inner bag column creating one continuous rigid shaft. If the column itself is not long enough then a column extension or strut such as foot 84 may be inserted to provide mechanical rigidity over the vertical dimension of the device.

All along the length of the package, the column provides for stability and integrity of the package and allows a reduction in the package wall thickness, which in turn may save on package materials. For example a rigid plastic container can be changed to soft plastic, or a thick cardboard package can be changed to thin cardboard with or without lamination, as in the examples below.

Figure 13:
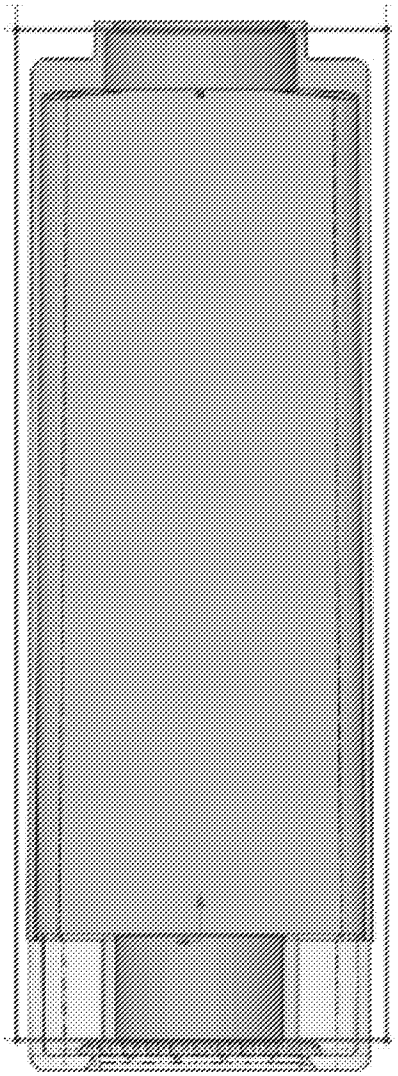
FIG. 13 shows the same as FIG. 12 but with a different kind of canister according to an embodiment of the present invention.

Reference is now made to FIG. 13 which is a side elevation of the package of FIG. 12, showing how the packaging fits around the sub-assembly. More generally the package may be flexible or rigid, and include collapsible tubing, and bottles. The column may be constructed using one, two three or more parts as long as a rigid structure is created when the parts are connected. In some cases the column may be made of a bottom piece that sticks out from the bottom of the package, together with and intermediate part that is part of the inner bag and a top part that sticks out from the valve.

The column may be round, square, hex etc, and may or may not be hollow. The column may be utilized for other needs such as piping the fluid between the inner bag and the valve.

Reference is now made to FIG. 14 which shows an outer packaging 100 made of folded cardboard sheet. Actuator 102 allows the pressurized content to be released. Within the packaging 100 is a sub-assembly such as that shown in FIG. 12 with a foot, as the cardboard may not have the mechanical strength to resist stacking, filling, dropping or provide a reaction against the pressing of valve 102. The foot also enables reducing the wall thickness of the package to a minimum while still maintaining the integrity of the package.

FIG. 15 illustrates a blow-molded plastic package 104. An actuator 106 sits atop the package and again, a sub-assembly as shown in FIG. 12 may provide the mechanical integrity necessary. A mounting cup edge 107 rests on the rim of an upper hole of the package.

Figure 22:
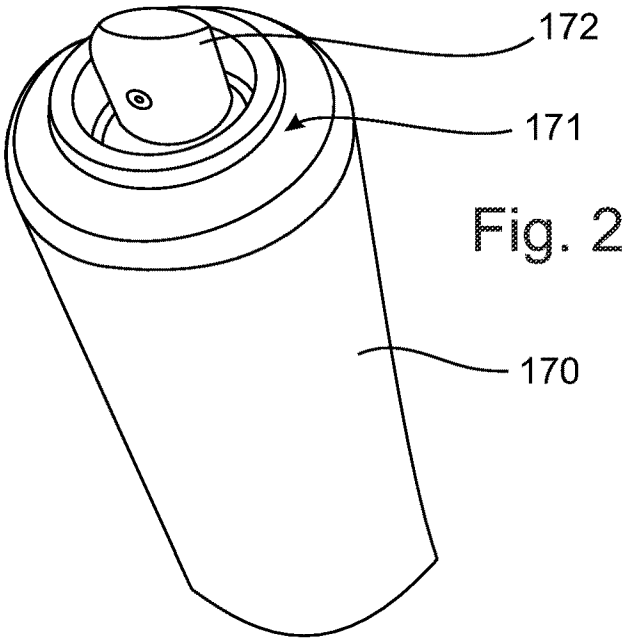
FIG. 22 illustrates a collapsible tube type of packaging made by extrusion and having a fingerpress actuator according to an embodiment of the present invention.

FIG. 16 shows an injection molded package 108. As before, the sub-assembly of FIG. 12 may provide the necessary mechanical strength. FIG. 22 discussed below shows a collapsible tube version of the packaging.

Reference is now made to FIG. 17 which is a side 120 and plan 121 view and a cross section 122 of a container based on the outer packaging 100 of FIG. 14 made of folded cardboard sheet. Within the packaging 100 is a sub-assembly 124 such as that shown in FIG. 12 with a foot 126, as the cardboard may not have the mechanical strength to provide a reaction against filling, dropping, stacking and actuation from above. The package may have a hole on top and fitment around it to connect the sub-assembly to the package. The connection can be as described in FIG. 5 or by other ways. The top 124 of the package includes the hole, which may accept the valve so that the mounting cup edge can rest on the rigid flange of the hole, which may be plastic and/or may be the flange shown above in FIG. 5. In the embodiment of FIG. 17 there is no need for the sealing gasket under the mounting cup. Thus free flow of air to the container may avoid resistance when the inner bag empties.

Top fixation may be as per FIG. 5 above or using a 2 piece flange, in which a bottom flange is connected to the package and a top flange snaps to the bottom flange, locking the mounting cup in between.

FIG. 18 illustrates a side 130 and plan 131 view and a cross section 132 of a container based on a blow-molded plastic package 104. Within the packaging 104 is a sub-assembly 134 such as that shown in FIG. 12 with a foot 136, as the blow molded plastic may not have the mechanical strength for filling, stacking, or dropping or to provide a reaction against actuation from above. The use of an extended column also enables reducing to a minimum the wall thickness of the package while still maintaining the integrity of the package. Location lugs 138 in the bottom of the package may mate with corresponding features in the foot 136, thus providing locators for the end of the column or the column extension and allowing the sub-assembly 134 to be held firmly within the package. The foot 136 can be fixed mechanically to the base of the packaging by heat welding, gluing, snapping etc. Another option is that a portion of the column may be provided with the package at the bottom and may connect to the inner bag column creating one continuous rigid shaft.

The top 131 of the package includes a hole, which may accept the valve so that the mounting cup edge can rest on the rigid flange of the hole, which may be plastic and/or may be the flange shown above in FIG. 5. Under the rim there is a peripheral indentation to allow soft crimping. In the embodiment of FIG. 17 there is no need for the sealing gasket under the mounting cup. Thus free flow of air to the container may avoid resistance when the inner bag empties.

FIG. 19 illustrates a side 140 and plan 141 view and a cross section 142 of a container based on injection molded package 108. Within the packaging 108 is a sub-assembly 144 such as that shown in FIG. 12 with a foot 146, as the injection molded plastic may not have the mechanical strength for filling, stacking, dropping or to provide a reaction against actuation from above. Shaping 148 built into the base of the injection molded package 108 may mate with the bottom of the foot 146 to ensure secure location.

The top 141 of the package includes a hole, which may accept the valve so that the mounting cup edge can rest on the rigid flange of the hole, which may be plastic and/or may be the flange shown above in FIG. 5. Under the rim there is a peripheral indentation to allow soft crimping. In the embodiment of FIG. 17 there is no need for the sealing gasket under the mounting cup. Thus free flow of air to the container may avoid resistance when the inner bag empties.

Figure 20:
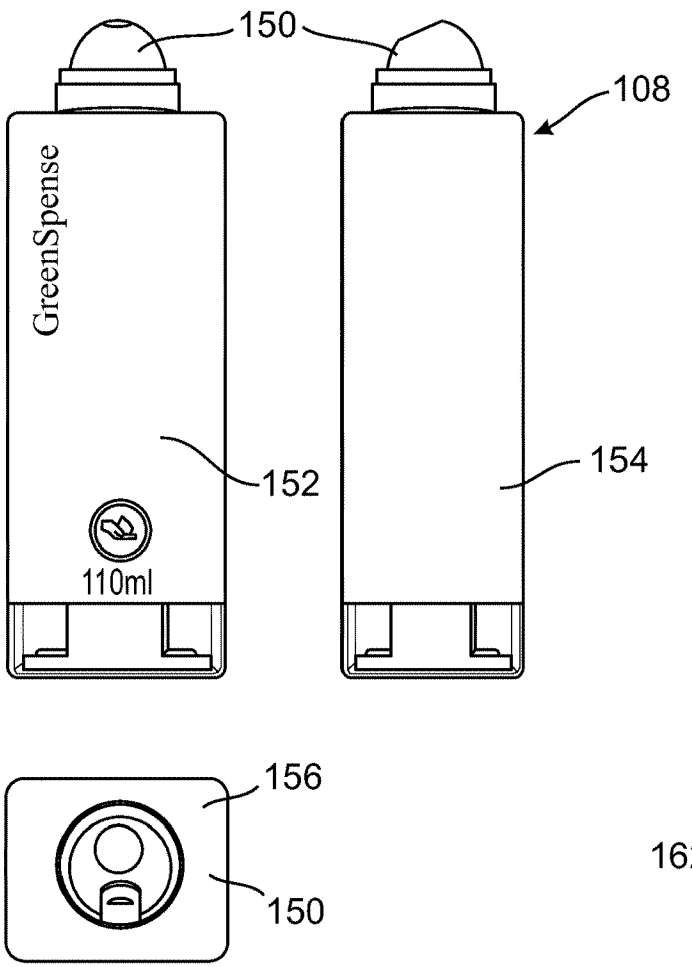
FIG. 20 shows a version of the injection molded packaging according to an embodiment of the present invention which is made from plastic.

Reference is made to FIG. 20, which illustrates the blow molded package 108 with actuator 150. The package is shown as a front elevation 152, side elevation 154 and plan 156.

Figure 21:
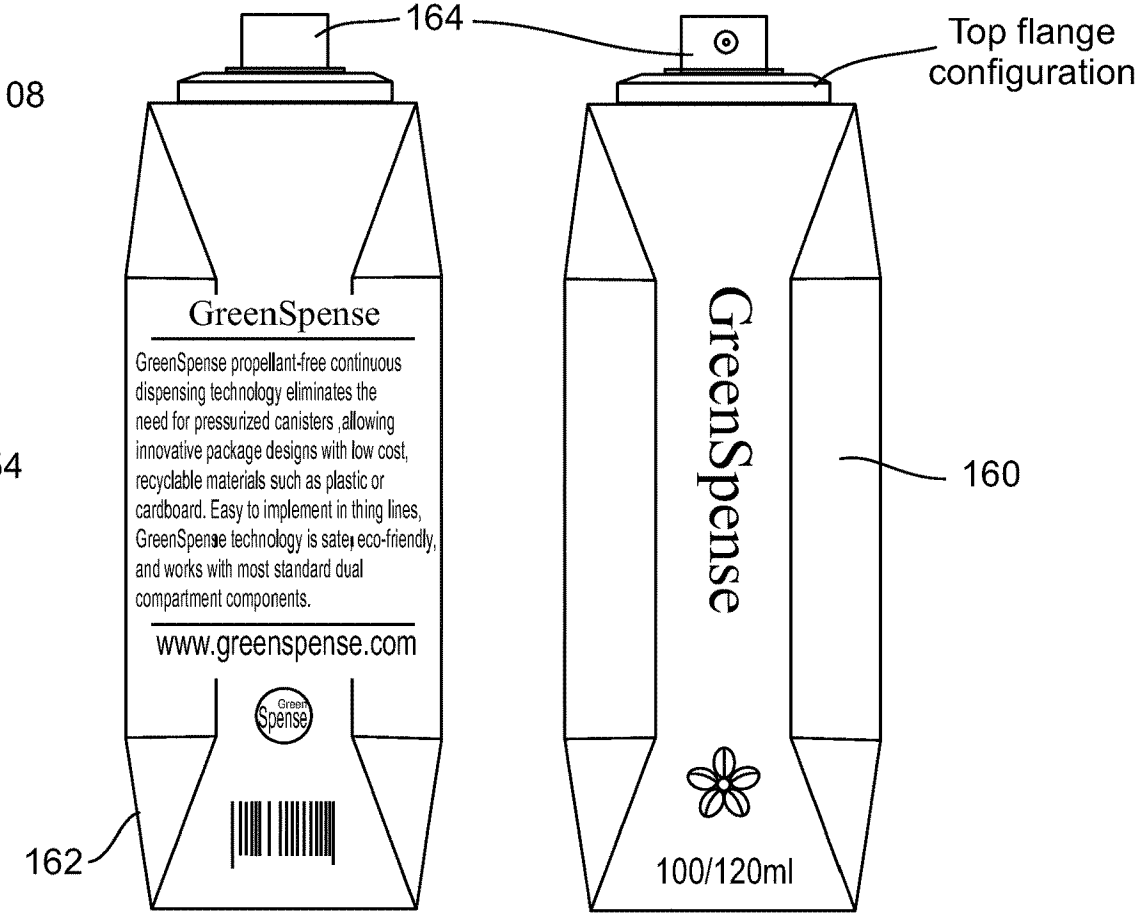
FIG. 21 is a simplified view of the cardboard packaging according to an embodiment of the present invention with a fingerpress actuator.

FIG. 21 illustrates front 160 and side 162 elevations of cardboard-based package 100. A standard finger press valve 164 is provided.

FIG. 22 illustrates a prototype plastic package 170 with a finger press actuator 172. The package is a collapsible tube that may be made by an extrusion process. The collapsible tube comprises a top rigid area 171 that has a hole to accommodate the valve and the mounting cup. The connection may comprise a groove in the mounting cup to which the inward facing circular edge of the package fits, and the same arrangement may be used with the cardboard package, or a double flange may be used to fix the rim of the cup. If the package material is suitable, then crimping may be applied to cause the mounting cup to bend under the top area 171.

Figure 23:
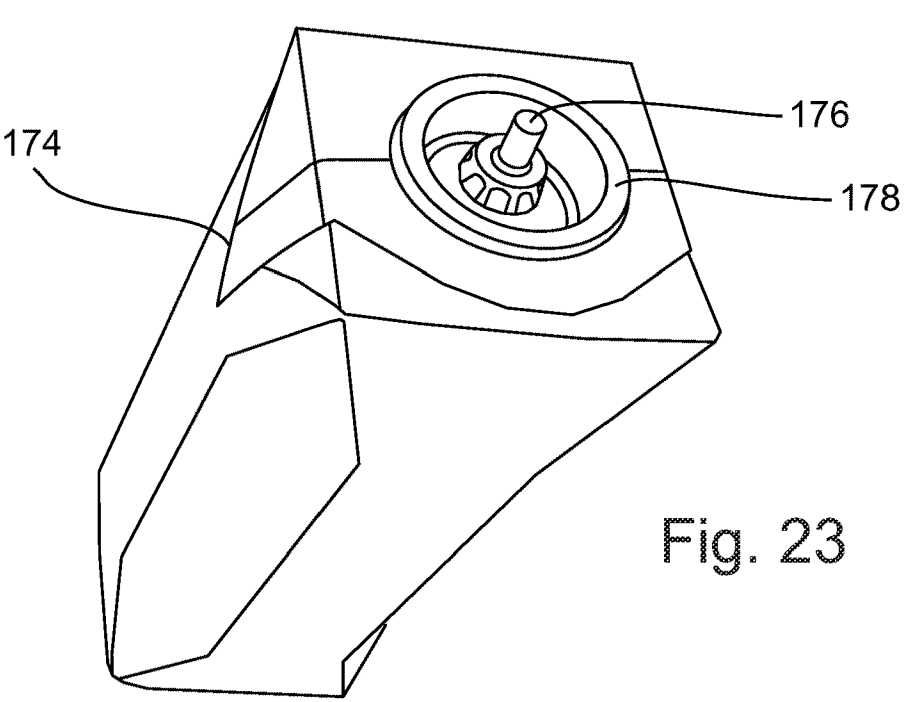
FIG. 23 shows the cardboard packaging with the valve and without an actuator, according to an embodiment of the present invention.

FIG. 23 illustrates a prototype cardboard package 174 with a valve stem 176 and cup 178, where the cup is fitted to the cardboard package (not shown).

Figure 24:
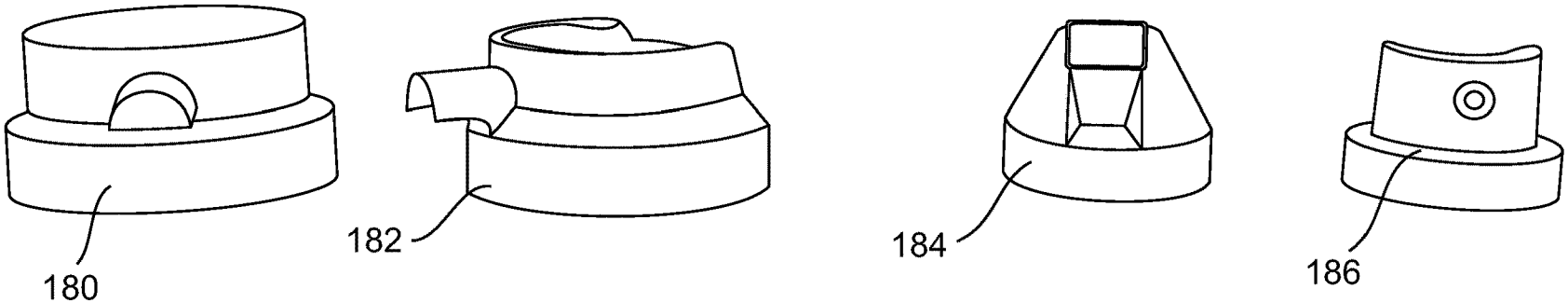
FIG. 24 shows four different exemplary actuators that can be applied to canisters and packaging of the present embodiments.

FIG. 24 illustrates a series of finger press actuator tops 180, 182 that fit over the mounting cup, and 184 and 186 which fit inside the mounting cup and allow the valve stem to be actuated to expel material via openings provided in the tops. Alternative actuators may fit on the package rather than the mounting cup.

Figure 25:
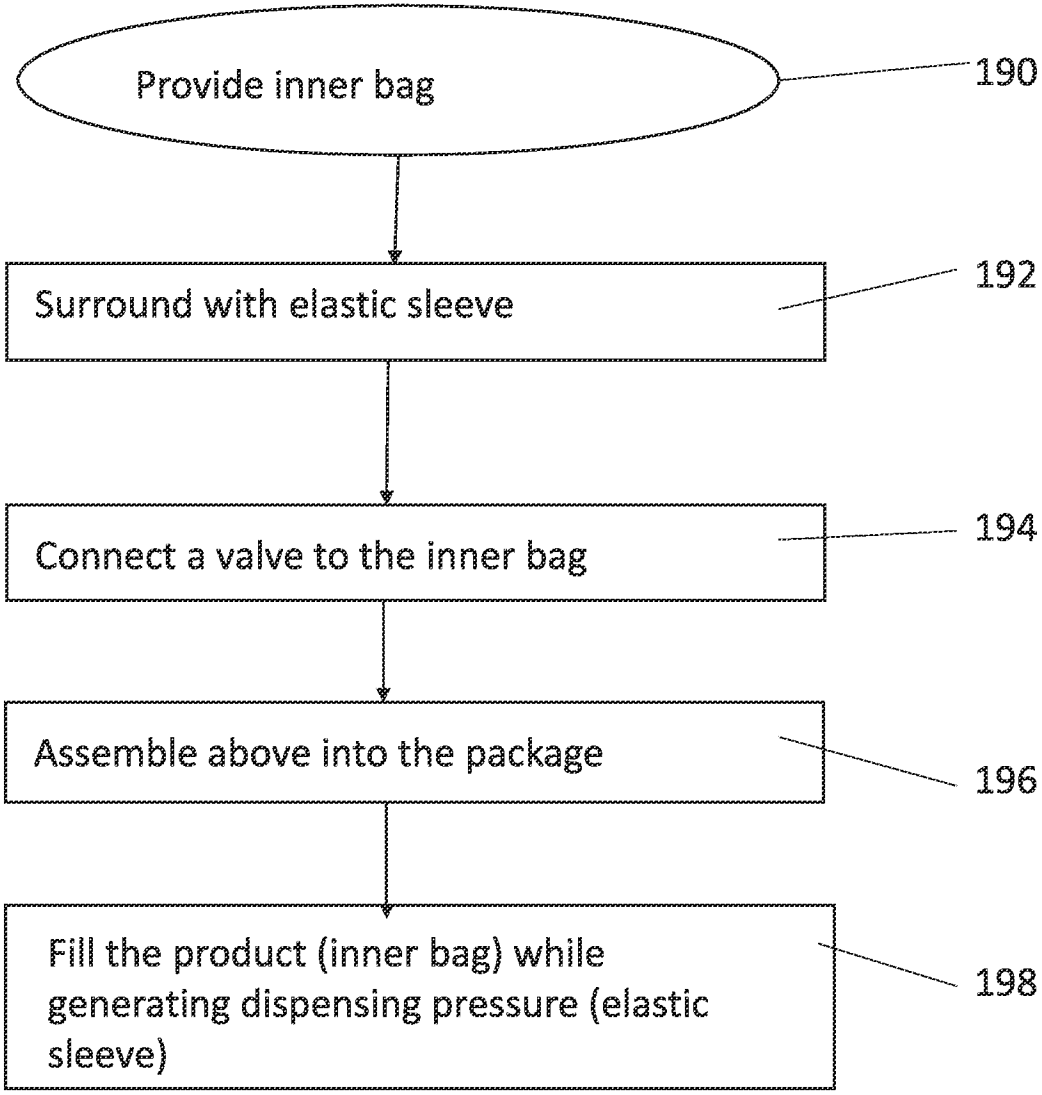
FIG. 25 is a simplified flow chart illustrating a generalized process for manufacturing a propellant-free device including fitting the valve to the package according to the present embodiments.

Reference is now made to FIG. 25, which illustrates a method of manufacturing a packaged propellant free continuous dispensing device. The method of manufacturing a propellant free continuous dispensing device may include providing an inner bag as shown in box 90, and surrounding the inner bag with an elastic sleeve. A control release valve as discussed above may be mounted 194 in a mounting cup to be attached to the inner bag, typically via the central column. At some stage, the inner bag is filled with fluid against the pressure of the elastic sleeve. The inner assembly is enclosed within a package which has a flange at the top for the valve, as shown in box 196. In box 198 the flange and mounting cup are fitted together, for example by snapping, so that the inner sub-assembly is fixed within the package.

In embodiments, the valve may be attached to the packaging, via the mounting cup, by use of complementary shaping, complemented by heat welding, or other mechanical connections such as snapping and/or screwing, or chemical connections such as gluing.

It is expected that during the life of a patent maturing from this application many relevant aerosol and package manufacturing technologies will be developed and the scopes of the corresponding terms are intended to include all such new technologies a priori.

The terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention, and the present description is to be read as if such combinations are clearly written therein and fully described. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A propellant free continuous dispensing device comprising:

An inner bag containing fluid or viscous materials under pressure;

a valve attached to said inner bag to controllably release said fluid, the valve mounted in a mounting cup;

a package enclosing said inner bag, the package having a first end and a base end opposite said first end, the package further having an inner side towards said inner bag and an outer side;

a flange contacting said outer side of said packaging away from said inner bag and closing said package at said first end, the flange being sized for said mounting cup to fit within said flange, and wherein at least one of said flange and said cup is springy; and a rigid column extending from said valve along a length of said pressurized container and towards said base end of said package, said rigid column being hollow to allow piping of said fluid from said inner bag to said valve, said rigid column further comprising a column extension reaching to and connecting with said base end of said package, thereby to provide mechanical rigidity over a vertical dimension of said device.

2. The propellant free dispensing device of claim 1, wherein said flange and said mounting cup are provided with complementary shapes respectively, said complementary shapes allowing location of said mounting cap into said flange.

3. The propellant free dispensing device of claim 1, wherein said flange comprises two flange ends and a rim of said mounting cup is closed within said ends.

4. The propellant free dispensing device of claim 1, wherein said mounting cup comprises a rim and a peripheral indentation underneath said rim for crimping of said flange.

5. The propellant free continuous dispensing device of claim 1, wherein said base end of said package comprises at least one locator for locating said rigid column.

6. The propellant free continuous dispensing device of claim 1, wherein said flange is non-metallic.

7. The propellant free continuous dispensing device of claim 1, wherein said package is non-metallic.

8. The propellant free continuous dispensing device of claim 7, wherein said package is injection moulded.

9. The propellant free continuous dispensing device of claim 7, wherein said package is blow moulded.

10. The propellant free continuous dispensing device of claim 1, wherein said package comprises plastic or glass, or sheet, or folded sheet, or cardboard.

11. The propellant free continuous dispensing device of claim 1, wherein said inner bag is pressurized by an elastic sleeve.

12. The propellant free continuous dispensing device of claim 1 wherein said valve is operated by pressing into said package against a restoring force.

13. The propellant free continuous dispensing device of claim 1, wherein said valve is a tilting valve operated by tilting to one side against a restoring force.

14. The propellant free continuous dispensing device of claim 1, wherein said valve is operated by rotation against a restoring force.

15. The propellant free continuous dispensing device of claim 14, wherein said rotation is carried out for continuous or dosed dispensing.

16. The propellant free continuous dispensing device of claim 2, wherein said complementary shapes comprise at least one groove and at least one corresponding protrusion.

17. The propellant free continuous dispensing device of claim 12, wherein said at least one groove and said at least one corresponding protrusion are continuous around different ones of an outer circumferential contour of said cup and an inner circumferential contour of said flange.

18. A propellant free continuous dispensing device comprising:

an inner bag containing fluid or viscous materials under pressure;

a valve attached to said inner bag to controllably release said fluid, the valve mounted in a mounting cup;

a package enclosing said inner bag, the package having a first end and a base end opposite said first end, the package further having an inner side towards said inner bag and an outer side;

a flange closing said package from said outer side at said first end, the flange being sized for said mounting cup to fit within said flange, the flange and mounting cups having respectively complimentary shapes comprising at least one lug and at least one locating hole; and a rigid column extending from said valve along a length of said pressurized container and towards said base end of said package, said rigid column being hollow to allow piping of said fluid from said inner bag to said valve, said rigid column further comprising a column extension reaching to and connecting with said base end of said package, thereby to provide mechanical rigidity over a vertical dimension of said device.

19. The propellant free continuous dispensing device of claim 2, wherein said complementary shapes comprise corresponding spiral threads.

20. The propellant free continuous dispensing device of claim 1, wherein the valve is mounted to rotate against a restoring force to open and carry out said controlled release.

21. The propellant free continuous dispensing device of claim 1, wherein the valve is mounted to be opened by tilting a lever sideways against a restoring force.

22. The propellant free continuous dispensing device of claim 1, wherein the valve is held within packaging, and wherein the packaging comprises a box obtained by folding a sheet.

23. The propellant free continuous dispensing device of claim 22, wherein said sheet is a cardboard sheet or a laminated cardboard sheet.

24. A method of manufacturing a propellant free continuous dispensing device comprising:

providing an inner bag;

surrounding said inner bag with an elastic sleeve;

attaching a control release valve mounted in a mounting cup to said inner bag;

enclosing said inner bag in a package, the package having a first end and a base end opposite said first end, and the first end comprising a flange structure fitting down over and surrounding said package from outside;

extending a rigid column from said valve along a length of said pressurized container towards said base end of said package, said rigid column being hollow to allow piping of said fluid from said inner bag to said valve;

providing a column extension reaching to and connecting with said base end of said package, thereby to provide mechanical rigidity over a vertical dimension of said device; and fitting said mounting cap within said flange by locating together complementary shapes on said mounting cap and said flange, one of said cup and said flange being springy.

* * * * *